United States Patent [19]

Bentley et al.

[11] 4,165,022

[45] Aug. 21, 1979

[54] HAND-HELD COATING-DISPENSING APPARATUS

[75] Inventors: Stanley L. Bentley; David G. Jessup, both of Indianapolis, Ind.

[73] Assignee: Ransburg Corporation, Indianapolis, Ind.

[21] Appl. No.: 773,520

[22] Filed: Mar. 2, 1977

[51] Int. Cl.[2] ..... B05B 5/02

[52] U.S. Cl. ..... 222/76; 222/325; 361/235; 239/704

[58] Field of Search ..... 222/76, 325, 326, 327; 239/15, 690–708; 118/621, 627, 629; 361/227, 228, 235; 331/14

[56] References Cited

U.S. PATENT DOCUMENTS

| | | | |
|---|---|---|---|
| 3,273,015 | 9/1966 | Fischer | 239/15 X |
| 3,367,578 | 2/1968 | Juvinall et al. | 239/15 |
| 3,567,996 | 3/1971 | Gordon et al. | 361/235 |
| 3,599,038 | 8/1971 | Skidmore | 118/621 X |
| 3,731,145 | 5/1973 | Senay | 239/15 X |
| 3,893,006 | 7/1975 | Algeri et al. | 361/227 |
| 4,048,668 | 9/1977 | Von Bargen et al. | 361/235 |

*Primary Examiner*—Joseph J. Rolla

*Attorney, Agent, or Firm*—Merrill N. Johnson; Richard D. Conard

[57] ABSTRACT

An electrostatic, coating-dispensing apparatus includes an electrode upon which an electrostatic potential is impressed. The electrostatic potential is developed by a switching circuit, autotransformer and voltage multiplier from rectified line voltage. The entire apparatus is housed in a hand-held applicator to which line voltage is supplied. The apparatus includes a socket defined at one end thereof for interchangeably receiving containers holding various colors or types of coating material. Each container includes an electrode for contacting the first-mentioned electrode. The containers are shaped to fit snugly into the socket to hold the two electrodes in contact. An outer end wall of each container has a mesh portion through which charged particles of coating material from the interior of the container pass when the apparatus is activated.

15 Claims, 4 Drawing Figures

HAND-HELD COATING-DISPENSING APPARATUS

This invention relates to electrostatic apparatus for dispensing coating material, e.g., dry powders, or flock fibers. More particularly, the instant invention relates to an electrostatic, hand-held dispensing apparatus.

Several types of apparatus for dispensing flock fibers are known in the art. Such types of apparatus establish a relatively high potential difference between an electrode and a target or article to be coated. The particles of flock are then charged from the electrode and are allowed to move through the potential field and strike the target. Typically, the target is coated with an electrically conductive adhesive material. Such material causes the particles of coating material to stick to the target and removes their charge. The following United States and foreign patents are illustrative of apparatus which functions in this manner:

| Patent No. | Inventor | Issue Date |
|---|---|---|
| U.S. 3,691,991 | Luderer et al | September 19, 1972 |
| U.S. 3,551,178 | A. Chmelar | December 29, 1970 |
| U.S. 3,496,911 | A. Chmelar | February 24, 1970 |
| U.S. 2,777,977 | J. Everard | January 15, 1957 |
| U.S. 2,706,963 | R. Hug | April 26, 1955 |
| British Patent 1,387,632 | J. R. Mitchell et al | March 19, 1975 |

The apparatus of the aforementioned United States patents typically requires a relatively large, bulky, and generally expensive power supply. While such devices may be suitable for large-scale operations which apply, for example, flocking material or powder paint coatings on assembly lines, they are not suitable for the home hobbyist or other individual who wants to apply flock fibers or powder paint to articles on a small scale.

The apparatus of the aforementioned British patent includes a Van De Graaff generator for creating the necessary electrostatic potential. This apparatus is intended to be hand-held for the hobbyist or small scale operator. However, the Van De Graaff generator, when reduced to this small scale, suffers certain shortcomings. First, in the small space available, the maximum potential difference that can be established between the final electrode and adjacent parts of the apparatus may not be high enough to provide a satisfactory coating. Second, when coating material begins to be discharged by the apparatus, the final electrode may become so heavily loaded that the final electrode voltage deteriorates below a level to provide satisfactory coating material flow rates.

Of course, there are several known types of electrical circuits for generating high electrostatic potential from line voltage or rectified line voltage. See, for example, Gordon et al U.S. Pat. No. 3,567,996. Further there are known types of hand-held dispensing apparatus which include high electrostatic potential generating circuits for use in applying coatings. See, for example, Buschor, U.S. Pat. No. 3,608,823 and Senay, U.S. Pat. No. 3,731,145, both of which utilize external low voltage, direct current power supplies.

According to the invention, an electrostatic coating-dispensing apparatus is completely contained within a hand-held housing. The dispensing apparatus includes a source of low voltage direct current, means responsive to the low voltage direct current for providing control signals, means for switching the low voltage in response to such control signals, means for boosting the switched low voltage, means for rectifying the boosted voltage, and an electrode for transmitting the boosted voltage to the individual particles of coating being dispensed. Means are provided for supplying alternating current line voltage to the housing, the line voltage supply means being coupled to provide operating potential to the low voltage direct current source.

In the illustrated embodiment, a switch for controlling the supply of line voltage to the low voltage direct current source controls the coating-dispensing apparatus. The low voltage direct current source itself includes rectifying means, such as diodes, and means for filtering the rectified line voltage. The rectifying means includes a voltage doubler circuit.

In the illustrated embodiment, the means for providing control signals in response to the low voltage direct current includes a DIAC oscillator circuit coupled to the low voltage source. The DIAC oscillator circuit produces control signal oscillation in response to the application of low voltage direct current. The output of the DIAC oscillator circuit is coupled to the switching means for controlling it.

Further in the illustrated embodiment, the switching means includes a silicon controlled rectifier (SCR). The gate electrode of the SCR is connected to the DIAC oscillator circuit output. A transformer winding is coupled to the anode and cathode of the SCR and low voltage direct current is supplied to the winding from the low voltage source. Switching of the SCR in response to oscillator output causes voltage variations to appear across the transformer winding.

In the illustrated embodiment, the transformer includes a high-voltage secondary winding for boosting the switched low voltage. The boosted voltage variations appearing across the transformer secondary are rectified in a high-voltage rectifier and multiplier and are transmitted by the final electrode to the coating material as the material is being dispensed.

In the illustrated embodiment of the apparatus, the coating material is contained in an interchangeable cartridge which fits snugly into a socket in the end of the coating-dispensing apparatus. The cartridge is retained in the socket so that a wall of the cartridge made of semi-conductive material is in contact with the final electrode.

The invention may best be understood by referring to the following description and accompanying drawings which illustrate the invention. In the drawings.

Figure 4:
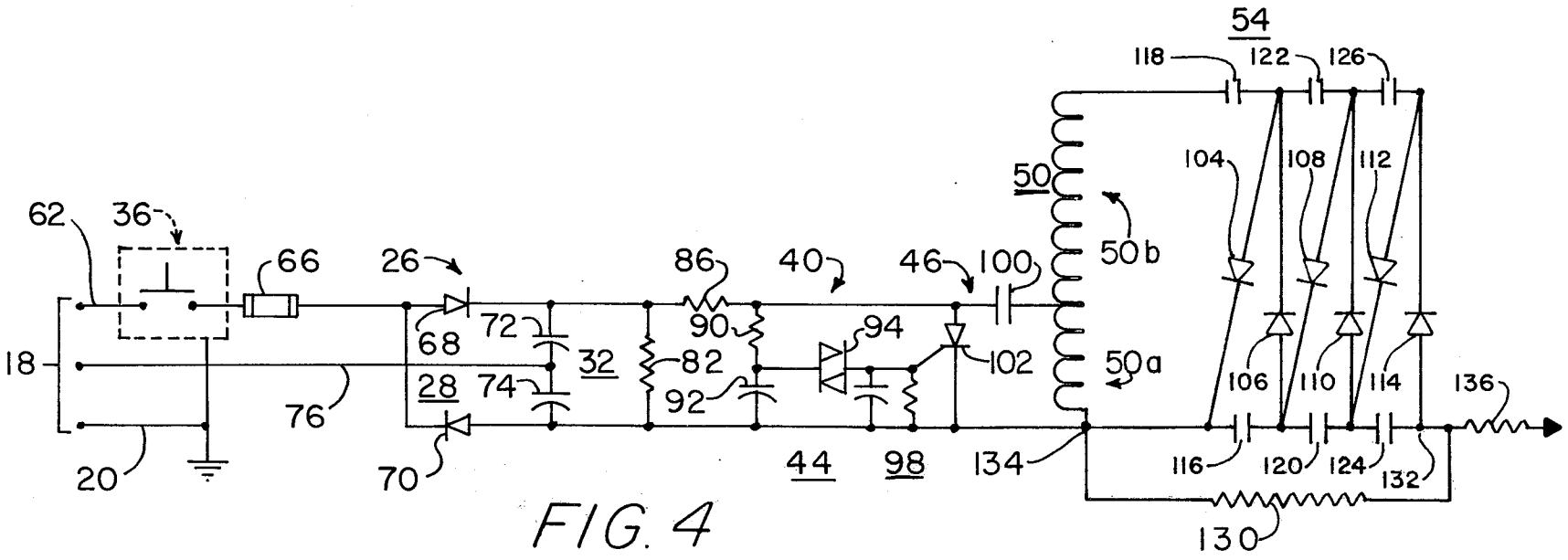
FIG. 4 is a circuit diagram of an illustrative electrostatic potential supply for the coating-dispensing apparatus.

Referring now to the Figs., an electrostatic, coating-dispensing apparatus 10 includes a hand-held housing 12 provided with a socket 14 at the distal end thereof. Means 16 for supplying the coating material to be dispensed is, in this embodiment, an interchangeable cartridge 17. An electric cord 18 with a ground lead 20 (FIG. 4) provides 110 volt alternating current line voltage to the apparatus in housing 12. With particular reference to FIG. 4, the apparatus includes a low voltage direct current source 26 with means 28 for rectifying the line voltage supplied through cord 18 and means 32 for filtering the rectified line voltage. A switch 36 in the line controls the supply of line voltage to low voltage source 26.

Apparatus 10 further includes means 40 responsive to the supply of low voltage direct current for providing control signals. In the disclosed embodiment, means 40 comprises an oscillator circuit 44. Means 46, including a solid state active current conducting device, is coupled to oscillator 44 and is responsive to the control signals to switch at the control signal frequency. The main current conducting path of switch means 46 is coupled to the low voltage direct current source 26. First boost means 50 including a transformer low voltage primary winding 50*a* is coupled to the switch means. Switching of switch means 46 causes voltage variations to be induced across winding 50*a*. Boost means 50 further includes a transformer high voltage secondary winding 50*b* responsive to the voltage variations across winding 50*a* to provide the boosted voltage variations. The boosted voltage variations are rectified by rectifying means 54 coupled to secondary winding 50*b*. In the disclosed embodiments, rectifying means 54 includes a high voltage multiplier.

A lead 62 from cord 18 is coupled through switch 36 and a fuse 66 to rectifier 28. Rectifier 28 in this embodiment includes oppositely poled diodes 68,70 in voltage-doubler configuration. Series-coupled filter capacitors 72,74 are coupled across diodes 68, 70 to store the rectified line voltage variations. The common terminal of capacitors 72, 74 is coupled to line 76 of cord 18. The external components of switch 36 are coupled to the ground lead 20 of cord 18 to protect the user.

Filter 32 includes a resistor 82. An isolation resistor 86 is coupled between low voltage power supply 26 and the remaining elements of the circuit of FIG. 4. Oscillator 44 includes a charging time-constant resistor 90 and capacitor 92. One terminal of a DIAC 94 is coupled to the junction of resistor 90 and capacitor 92. An R-C waveshaping circuit 98 is coupled to the other terminal of DIAC 94. The series combination of a storage capacitor 100 and primary winding 50*a* is also coupled across low voltage source 26 through resistor 86. An SCR 102 switches the voltage across capacitor 100 and winding 50*a* in response to the output control signal from oscillator 44 across waveshaping circuit 98. Such switching produces relatively low potential variations across winding 50*a*.

Voltage variations across winding 50*a* are transformed to substantially higher boosted voltage variations across the combination of windings 50*a* and 50*b*. Rectifier 54 is coupled across both windings to rectify these boosted voltage variations. Rectifier 54 in the illustrated embodiment includes diodes 104, 106, 108, 110, 112, 114 and storage capacitors 116, 118, 120, 122, 124, 126 in a typical voltage sextupler configuration. In the illustrated embodiments, all of the components of the voltage sextupler are "potted" into a housing 128 (see FIG. 1). A bleed resistor 130 is coupled between the output terminal 132 of the voltage multiplier and the common terminal 134 of the electrostatic potential generating circuit of FIG. 4. A high-resistance current limiting resistor 136 is coupled between terminal 132 and the final electrode 140 of the apparatus (see FIG. 1).

Final electrode 140 is supported in a baffle or divider 144 which forms the bottom of socket 14 at the distal end of housing 12. A short contact spring 152 extends forward from final electode 140 to insure contact between final electrode 140 and cartridge 17 which is inserted into socket 14. Housing 12 includes a pistol grip 156 with the switch 36 actuator conveniently located as the pistol "trigger."

Figure 1:
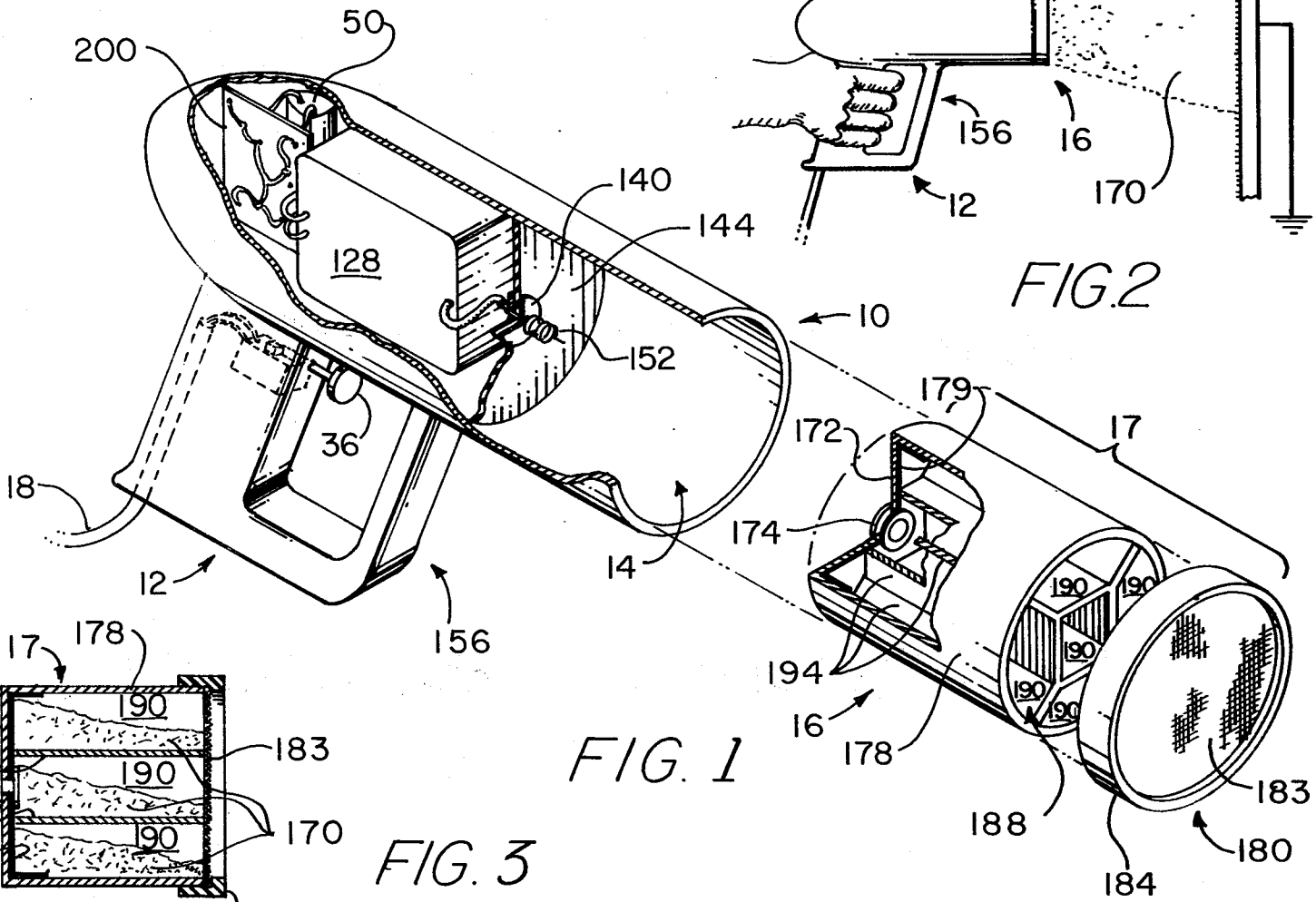
FIG. 1 is a partly fragmentary, partly exploded isometric view of a coating-dispensing apparatus constructed in accordance with the present invention.
Figure 3:
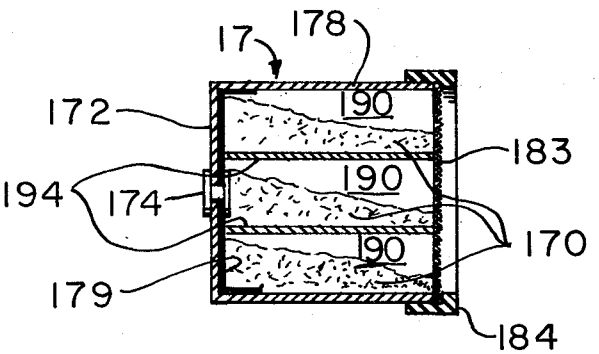
FIG. 3 is a vertical sectional view of a detail of the apparatus of FIG. 1.

Referring now specifically to FIGS. 1 and 3, interchangeable cartride 17 will be explained.

To transmit the electrostatic potential from final electrode 140 to particles 170 of coating material to be dispensed, cartridge 17 includes a first end 172 including a metallic button 174 which contacts spring 152 when cartridge 17 is inserted fully into socket 14. Cartridge 17 further includes a cylindrical side wall 178 which is adapted snugly to be received within socket 14. Side wall 178 may be constructed of plastic or other suitable material. Very good results have been obtained with a cartridge 17 including integral end wall 172 and side wall 178 formed from a non-conductive, flexible plastic. The inside of end 172 is coated with a layer 179 of a semi-conductive material such as the surface layer described in Gauthier U.S. Pat. No. 3,021,077. Charge is transmitted through button 174 into the interior of cartridge 17 where particles 170 lie against layer 179. Such arrangement allows cartridges 17 to be manufactured quite inexpensively.

A second end 180 of cartridge 17 is provided for passing charged particles 170 of coating material from cartridge 17 toward a target 182 (see FIG. 2) to be coated with coating material 170. Target 182 is coated with a layer of conductive undercoating or adhesive. Alternatively, target 182 may be conductive. In either case, the surface to be coated is grounded. In the illustrated embodiment, second end 180 is formed from plastic mesh or screen 183 held tightly in place by an annular locking ring 184 which engages side wall 178.

Figure 2:
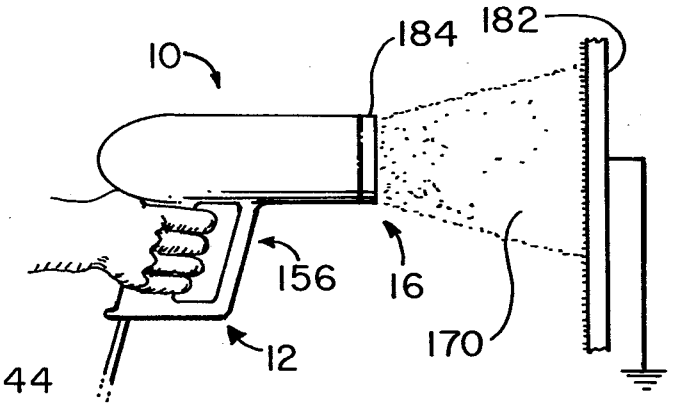
FIG. 2 is a diagrammatic side elevation of the apparatus of FIG. 1 in use.

As best illustrated in FIGS. 1 and 3, the interior 188 of cartridge 17 is divided into a plurality of longitudinally extending sections 190 which are provided by a number of partitions 194. Sections 190 extend substantially the full distance between cartridge ends 172 and 180. Partitions 194 may be integrally formed with one or both of walls 172, 178 or may be made separately and inserted into cartridge 17 during assembly of the cartridge. With interior 188 divided into sections 190, each of which is, in effect, a separate container for coating material, apparatus 10 can be held in a number of different orientations and still produce a substantially uniform distribution (as illustrated in FIG. 2) of charged particles 170 between the apparatus 10 and the target 182. An illustrative shape for sections 190 appears in FIG. 1. Other shapes may be used.

The housing 12 of FIGS. 1–2 desirably is made from a high-impact molded plastic. The electric circuitry of the electrostatic voltage generator, except for transformer 50 and high voltage rectifier and multiplier 54, can be mounted on a small printed circuit board 200 (FIG. 1) at the rear end of housing 12. An apparatus 10 constructed as herein described has developed a reliable output of 30 KV at 50 uA at final electrode 140. This output is ideal for the hobbyist who wishes to coat relatively small numbers of articles with, e.g., flock fibers.

Safety is a major concern in any apparatus which generates high electrostatic potential. A significant feature of the disclosed apparatus is the protection it affords the user against electrical shock from the final electrode 140 and, from semi-conductive layer 179 of cartridge 17. The protection is provided by the high-resistance current limiting resistor 136 coupled between rectifier 54 and final electrode 140, and by the resistive properties of semi-conductive layer 179.

What is claimed is:

1. An electrostatic coating-dispensing apparatus comprising a hand-held housing, means for supplying coating to be dispensed to the housing, a source of low voltage direct current, the low voltage direct current source being housed in the housing, means coupled to the low voltage direct current source for providing control signals, said control signal providing means being responsive to the low voltage direct current, means coupled to the low voltage direct current source and control signal providing means for switching the low voltage direct current in response to such control signals, means coupled to the switching means for boosting the switched low voltage, means coupled to the boosting means for rectifying the boosted voltage, an electrode coupled to the rectifying means for supplying the rectified and boosted voltage to the coating to be dispensed, and means for supplying alternating current line voltage to the housing, the line voltage supply means being coupled to the low voltage direct current source, the means for supplying coating to be dispensed comprising an interchangeable cartridge engageable with the electrode to define a self-contained dispenser for the particles of coating, said cartridge having an end wall adjacent said electrode and said end wall including a semi-conductive material portion to transmit charge from said electrode to the particles of coating.

2. The apparatus of claim 1 wherein the housing is pistol-shaped and includes a pistol grip, the apparatus further including a control switch coupled to the line voltage supply means and to the low voltage direct current source to control it, the control switch including a trigger mounted in the pistol grip.

3. The apparatus of claim 1 wherein the low voltage direct current source includes a circuit for rectifying and doubling the line voltage, and a circuit coupled to the rectifying and doubling circuit for filtering and storing the rectified and doubled line voltage variations.

4. The apparatus of claim 1 wherein the means for switching the low voltage direct current includes a silicon controlled rectifier having its gate electrode coupled for receiving control signals and its anode coupled to the means for boosting the switched low voltage.

5. The apparatus of claim 1 wherein the means for rectifying the boosted voltage includes a solid state rectifier and voltage multiplier circuit.

6. The apparatus of claim 1 wherein the control signal providing means includes an oscillator circuit responsive to the low voltage supplied by the low voltage direct current source.

7. The apparatus of claim 6 wherein the oscillator circuit includes a time constant charging circuit coupled to the low voltage direct current source and a DIAC coupled to the charging circuit and responsive to charging thereof to generate the control signals, the DIAC further being coupled to the switching means.

8. An electrostatic coating-dispensing apparatus comprising a hand-held housing including means for supplying alternating current line voltage to the housing, means for rectifying the line voltage, a switch for controlling the supply of line voltage to the rectifying means, an active current conducting device for switching the rectified line voltage, the active current conducting device having two electrodes providing a main current conducting path and a control electrode, oscillator means for controlling the active current conducting device, the oscillator means being coupled to the control electrode, first means for boosting the voltage across the main current conducting path, the first boost means being excited by the voltage variations appearing thereacross as the active current conducting device operates, second boost means for rectifying and further boosting the once-boosted voltage variations produced by the first boost means, the second boost means being coupled to the first boost means, an electrode for receiving the rectified twice-boosted voltage, the electrode means being coupled to the second boost means, and an interchangeable cartridge for supplying particles of coating to be dispensed, the cartridge being engageable with the hand-held housing, the cartridge including an end wall adjacent the electrode to couple charge therefrom, the end wall including a layer of semi-conductive material to transmit charge from the electrode to the particles of coating in the cartridge.

9. The apparatus of claim 8 wherein the means for rectifying the line voltage comprises a diode rectifier-doubler circuit.

10. The apparatus of claim 8 and further including means for filtering the rectified line voltage, the filter means being coupled to the line voltage rectifying means.

11. The apparatus of claim 8 wherein the active current conducting device is a silicon controlled rectifier, the anode and cathode of which provide the main current conducting path and the gate electrode of which is the control electrode.

12. The apparatus of claim 8 wherein the first boost means comprises a transformer having a first winding coupled to the line voltage rectifying means and the active current conducting device and a second winding coupled to the second boost means.

13. The apparatus of claim 8 wherein the oscillator means comprises a time constant charging circuit and a DIAC, the DIAC being coupled to the charging circuit for being controlled by said charging circuit and to the control electrode of the active current conducting device.

14. The apparatus of claim 5 wherein the second boost means comprises a solid state rectifier and multiplier circuit.

15. A coating dispensing applicator including hand-held means for housing the applicator components, the components comprising a source of low voltage direct current, means for providing control signals in response to the low voltage direct current, the control signal providing means being coupled to the low voltage direct current source, means for switching the low voltage direct current in response to such control signals, the switching means being coupled to the low voltage direct current source, means for boosting the switched low voltage, the boosting means being coupled to the switching means, means for rectifying the boosted voltage, the rectifying means being coupled to the boosting means, an electrode coupled to the rectifying means for supplying the rectified and boosted voltage to the coating to be dispensed, and an interchangeable cartridge for supplying coating to be dispensed, the cartridge being engageable with the hand-held means and with the electrode to define a self-contained coating dispensing applicator, the cartridge having an end wall adjacent the electrode, the end wall including a semi-conductive material portion to transmit charge from the electrode to the particles of coating in the cartridge.

* * * * *